United States Patent [19]

Renowden et al.

[11] Patent Number: 4,807,812

[45] Date of Patent: Feb. 28, 1989

[54] FUEL INJECTOR DESIGNED TO REDUCE FUEL VAPORIZATION

[75] Inventors: Paul S. Renowden, Hounslow; John H. Kenning, Sutton Coldfield; Ian S. Johnson, London, all of England

[73] Assignee: Lucas Industries Public Limited Company, Birmingham, England

[21] Appl. No.: 49,614

[22] Filed: May 13, 1987

[30] Foreign Application Priority Data

May 16, 1986 [GB] United Kingdom ..... 8611949

[51] Int. Cl.[4] ..... B05B 15/00

[52] U.S. Cl. ..... 239/132; 239/585

[58] Field of Search ..... 239/585, 533.3–533.12, 239/128, 132, 132.3; 123/468, 470, 41, 31

[56] References Cited

U.S. PATENT DOCUMENTS

| | | | |
|---|---|---|---|
| 4,055,396 | 4/1977 | Taxon et al. | 239/584 X |
| 4,385,339 | 5/1983 | Takada et al. | 239/585 X |
| 4,403,741 | 9/1983 | Moriya et al. | 239/585 |
| 4,455,982 | 6/1984 | Hafner et al. | 239/585 |
| 4,570,601 | 2/1986 | Ito et al. | 123/468 |

FOREIGN PATENT DOCUMENTS

| | | |
|---|---|---|
| 2528683 | 1/1976 | Fed. Rep. of Germany . |
| 2644135 | 4/1978 | Fed. Rep. of Germany . |
| 2057193 | 3/1981 | United Kingdom . |
| 2124554 | 2/1984 | United Kingdom . |

*Primary Examiner*—Andres Kashnikow
*Assistant Examiner*—Kevin P. Weldon
*Attorney, Agent, or Firm*—Balogh, Osann, Kramer, Dvorak, Genova & Traub

[57] ABSTRACT

A fuel injector for a petrol engine has an outer annular body and a core member mounted therein. The core member has a central passage which leads from a fuel inlet to adjacent a plate-like valve member which is biased into contact with a seat ring by a spring. The core member is surrounded by a solenoid winding which when energized causes the valve member to lift from the seat ring to allow fuel flow through an outlet orifice. The fuel is conveyed from the inlet to adjacent the valve member by a tubular member which is mounted in spaced relationship within the passage.

3 Claims, 2 Drawing Sheets

FUEL INJECTOR DESIGNED TO REDUCE FUEL VAPORIZATION

This invention relates to petrol injectors for delivering fuel to an air inlet of an engine, the injector including an electromagnetically operable valve incorporating a spring biased valve member which, when moved to an open position upon energisation of a solenoid forming part of the injector, allows petrol to flow from an inlet through an outlet orifice.

Fuel is supplied to the inlet at a regulated pressure the fuel generally being continuously pumped around a fuel circuit to which the inlet of the injector is connected. The amount of fuel supplied through the injector in normal use depends upon the duration of the electrical energising pulse applied to the solenoid. When the engine has been stopped after it has become thoroughly warm, the body of the injector absorbs heat particularly from the inlet manifold and because there is a residual amount of fuel in the injector, this fuel becomes heated and may vaporize. In these circumstances it is sometimes difficult to restart the engine and even when started the idling of the engine may be uneven due to the excessively heated fuel and/or fuel vapour.

The object of the present invention is to provide an injector of the kind specified in a simple and convenient form.

According to the invention a petrol injector of the kind specified includes a body assembly which defines a passage extending from the fuel inlet to adjacent the valve member, the passage accommodating a tubular member which extends with clearance within said passage, said tubular member forming the fuel conveying path from said inlet to adjacent the valve member.

Figure 1:
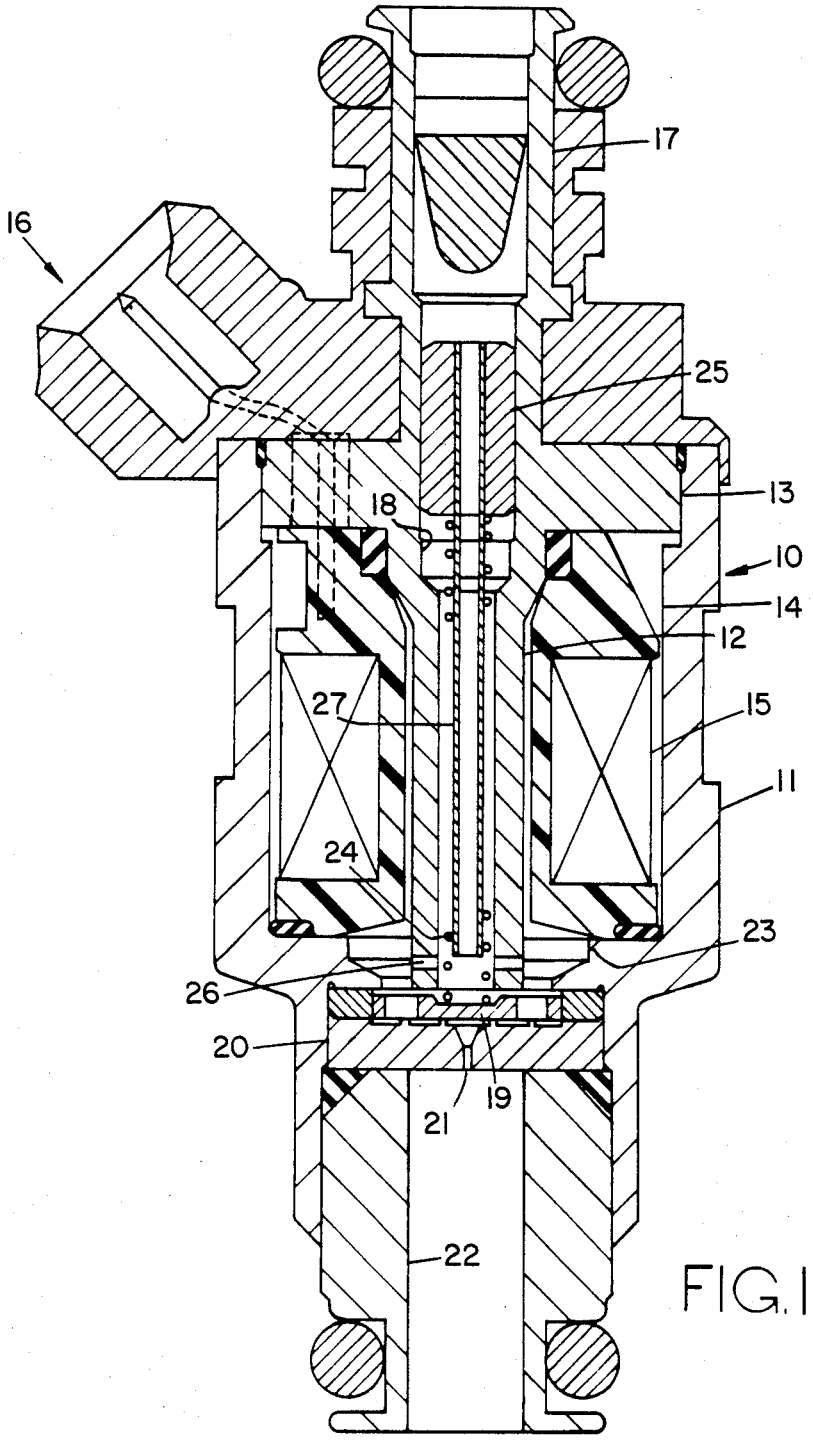
Figure 2:
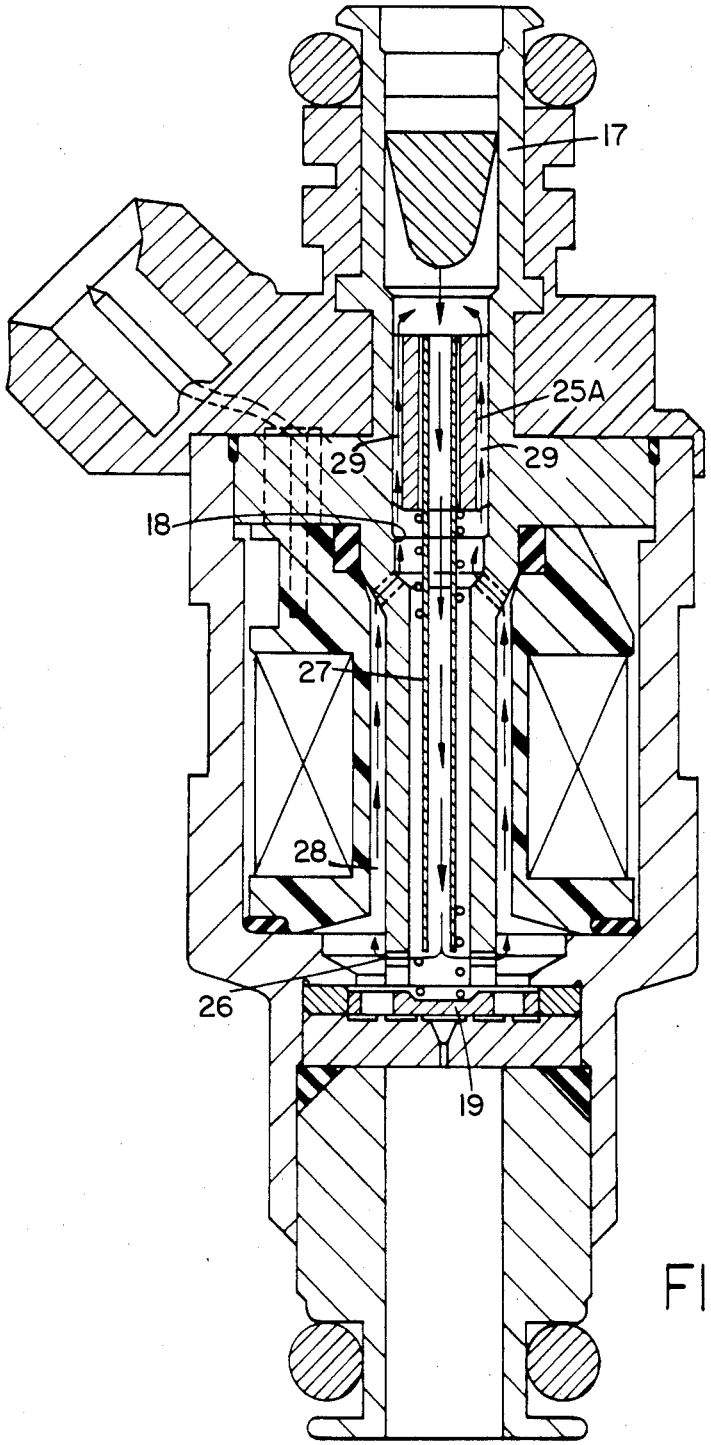

FIG. 1 and 2 show in sectional side elevation two examples of petrol injector in accordance with the invention.

Referring to FIG. 1 of the drawings the injector comprises a body assembly 10 which comprises an outer magnetic body 11 of hollow stepped form and within which extends a central core member 12. The core member is formed from magnetic material and is provided with a flange 13 which locates within the open and wider end of the body. Surrounding the core member is an electrically insulating former 14 upon which is wound a solenoid winding 15. Electrical connections 16 are provided to enable the solenoid winding to be connected to a source of electric supply.

The core member extends beyond the flange to define a fuel inlet 17 and within the core member is a stepped passage 18 which extends from the inlet to adjacent a plate-like valve member 19 which is biased by a coiled compression spring 24 located within the passage 18, into contact with annular seat members formed integrally with a seat ring 20. The seat ring 20 defines an outlet orifice 21 which opens into a tubular outlet member 22 which is secured within the narrower end of the body 11.

The core member and an inwardly directed flange 23 formed on the body 11, form the pole pieces of the solenoid and the valve member 19 is formed from magnetic material so that when the solenoid is energised the valve member is lifted from the seat member against the action of the spring.

The spring is located in the passage 18 between the valve member 19 and a plug 25 which is an interference fit in the bore 18 whereby the force exerted by the spring can be adjusted.

The core member adjacent the valve member is provided with transverse drillings 26 through which fuel can flow. In use when the valve member is lifted from the seat member fuel flows from the inlet through drillings 26, apertures in the valve member and through the outlet 21. The quantity of fuel flowing depends upon the duration of the energising pulse which is applied to the solenoid winding but in addition it does depend on the pressure of fuel at the inlet and also upon the density of the fuel.

Since the injector is mounted on the inlet manifold of the engine it will in normal use remain fairly cool as also will the fuel which is supplied to it. When however the associated engine is stopped, heat from the engine soaks into the injector and the residual fuel within the injector becomes heated and it may become sufficiently heated to vaporize.

In order to try to ensure that the fuel supplied through the nozzle when an attempt is made to restart a hot engine, is as cool as possible there is provided in the passage 18 a tubular member 27 which extends with clearance within the passage 18 to adjacent the transverse drillings 26. The tubular member is carried by the plug 25 and the effect of the tubular member is to transport fuel from the inlet 17 to the drillings 26 without the fuel coming into contact with the hot core member 12. The fuel supplied to the inlet 17 will be comparatively cool because it is constantly circulated through a fuel circuit which may also include the fuel supply tank.

FIG. 2 of the drawings shows a modification in which in addition to the tubular member 27, passage 28 are provided between the core member 12 and the former 14. These passages extend from adjacent the transverse drillings 26 and reconnect with the passage 18 at a position close to the plug 25A. The plug 25A is modified to provide a series of channels 29 which connect with the passages 28 and the arrangement is such that when the engine has been stopped, convection currents will flow and cause circulation of the fuel downwardly through the tubular ember 27 and upwardly through the passages 28 and channels 29. This circulation of fuel, which is entirely due to convection, will act to prevent local excessive heating of the fuel, particularly the fuel which is in the region of the valve member 19. As soon as an attempt is made to start the engine cool fuel from the inlet will again be delivered to adjacent the valve member through the tubular member 27.

We claim:

1. A petrol injector for delivering fuel to an air inlet manifold of an engine, the injector comprising an outer hollow body, a core member extending within the body, the body and core member being formed from magnetic material, a solenoid winding surrounding the core member, a seat ring defining an outlet orifice, the seat ring being mounted in one end of the body in spaced relationship to one end of the core member, a plate valve member formed from magnetic material located between the seat ring and said one end of the core member, a passage extending between the ends of the core member, the other end of the core member defining a fuel inlet, a coiled compression spring located in said passage, one end of the spring engaging said valve member to urge the valve member into sealing engagement with said seat ring, a spring abutment mounted in said passage at a position remote from said valve member, said abutment being engaged by the other end of said spring, and a tubular member extending within said spring, said tubular member being mounted on said abutment and acting to convey fuel from said fuel inlet to adjacent said valve member when said solenoid is energized to lift the valve member from said seat ring.

2. An injector according to claim 1 including transverse drillings formed in said core member adjacent said valve member.

3. An injector according to claim 2 including passages defined between the exterior surface of the core member and the solenoid, said passages at one end communicating with said transverse drillings respectively and at their other ends communicating with the first mentioned passage in the core member and channels formed in the abutment to permit fuel to circulate due to convection, along said passages thereby to minimize excessive local heating of the fuel in the injector.

* * * * *